US008489010B2

(12) United States Patent
Taki et al.

(10) Patent No.: US 8,489,010 B2
(45) Date of Patent: Jul. 16, 2013

(54) IMAGE DELETE APPARATUS AND RECORDING MEDIUM CARRYING METHOD OF IMAGE DELETE APPARATUS

(75) Inventors: Hiroyuki Taki, Shizuoka (JP); Isao Yahata, Shizuoka (JP); Takahiro Kawaguchi, Shizuoka (JP); Hiroyuki Taguchi, Shizuoka (JP); Hiroyuki Tsuchihashi, Shizuoka (JP); Ken Iguchi, Shizuoka (JP)

(73) Assignees: Kabushiki Kaisha Toshiba, Tokyo (JP); Toshiba Tec Kabushiki Kaisha, Toyko (JP)

( * ) Notice: Subject to any disclaimer, the term of this patent is extended or adjusted under 35 U.S.C. 154(b) by 321 days.

(21) Appl. No.: 12/848,918

(22) Filed: Aug. 2, 2010

(65) Prior Publication Data

US 2011/0033216 A1 Feb. 10, 2011

Related U.S. Application Data

(60) Provisional application No. 61/231,200, filed on Aug. 4, 2009, provisional application No. 61/242,727, filed on Sep. 15, 2009.

(51) Int. Cl.
*G03G 15/20* (2006.01)

(52) U.S. Cl.
USPC ..... 399/341; 399/361; 399/16; 399/407; 271/3.06

(58) Field of Classification Search
USPC ..... 399/341, 361, 16, 382, 375, 407–410
See application file for complete search history.

(56) References Cited

U.S. PATENT DOCUMENTS

| | | | | |
|---|---|---|---|---|
| 5,545,381 | A * | 8/1996 | Iida et al. | 422/186 |
| 8,260,188 | B2 * | 9/2012 | Yahata et al. | 399/411 |
| 2004/0188919 | A1 * | 9/2004 | Sakamaki et al. | 271/122 |
| 2006/0279780 | A1 * | 12/2006 | Anno et al. | 358/1.15 |

FOREIGN PATENT DOCUMENTS

| | | | |
|---|---|---|---|
| JP | 876534 | A | 3/1996 |
| JP | 891602 | A | 4/1996 |
| JP | 2009137716 | A | 6/2009 |

* cited by examiner

*Primary Examiner* — Walter L Lindsay, Jr.
*Assistant Examiner* — Roy Y Yi
(74) *Attorney, Agent, or Firm* — Patterson & Sheridan, L.L.P.

(57) ABSTRACT

An image delete apparatus has a paper feed tray that feeds recording media, a group of sensors containing a double-feed detection sensor that senses double-feed of the recording media and a media sensor that senses thicknesses of the recording media, a folding unit, and an auxiliary carrying path, and includes a collecting unit that folds and collects the recording media.

17 Claims, 6 Drawing Sheets

IMAGE DELETE APPARATUS AND RECORDING MEDIUM CARRYING METHOD OF IMAGE DELETE APPARATUS

CROSS-REFERENCE TO RELATED APPLICATIONS

This application is based upon and claims the benefit of priority from the prior the U.S. Patent Application No. 61/231,200, filed on Aug. 4, 2009, and the prior the U.S. Patent Application No. 61/242,727, filed on Sep. 15, 2009 and the entire contents of which are incorporated herein by reference.

FIELD

Embodiments of the present invention relate to an image delete apparatus that deletes an image of a recording medium with the image formed thereon using a color-erasable developer and a recording medium carrying method of the image delete apparatus.

BACKGROUND

Nowadays, image forming apparatuses that form images using color-erasable developers and color erasing apparatuses are introduced from the requirement of resource saving. The color erasing apparatus deletes an image by applying heat and light to a recording medium with the image formed thereon using the color-erasable developers and erasing color of the developer. Accordingly, the recording medium after color erasing is reusable.

The recording medium with the image once formed thereon may be stapled or a sticky note may be put thereon. The recording medium under the condition becomes stuck in a recording medium carrying path, and may cause jamming and damage on the apparatus In this connection, a technology of providing a sensing device that senses double-feed and stopping carriage of recording media if the double-feed is sensed is proposed.

Further, a technology of providing a sensor that senses a thickness of the recording medium in the middle of the recording medium carrying path and discharging the recording medium via a normal recording medium carrying path to the outside of the apparatus if it has an unexpected thickness is proposed.

Furthermore, a technology of providing a sensor that senses a thickness of the recording medium in the middle of the recording medium carrying path and collecting the recording medium in a collection box if it has an unexpected thickness is proposed. In the technology, the housing of the image delete apparatus is larger.

DETAILED DESCRIPTION

Throughout this description, the embodiments and examples shown should be considered as exemplars, rather than limitations on the apparatus and methods of the present invention.

Hereinafter, one embodiment of an image delete apparatus and a recording medium carrying method of the image delete apparatus according to the invention will be explained in detail using the drawings.

The image delete apparatus includes a paper feed tray that feeds recording media, a group of sensors containing a double-feed detection sensor that senses double-feed of the recording media and a media sensor that senses thicknesses of the recording media, a collecting unit that folds and collects the recording media, a switching unit that switches carrying directions of the recording media, and a heating unit that heats the recording media to a color erasing temperature of the developer or higher.

Figure 1:
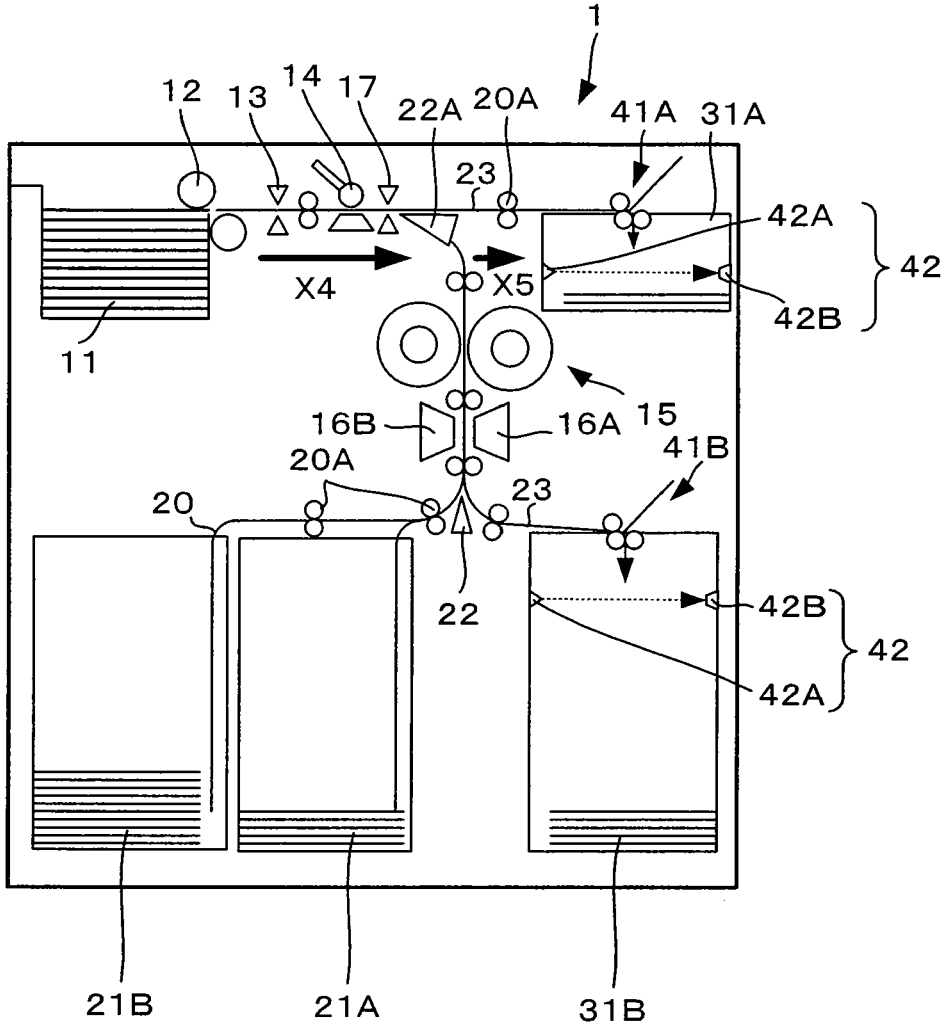
FIG. 1 is a side view showing a configuration of an image delete apparatus.

FIG. 1 is a side view showing a configuration of an image delete apparatus 1 of the embodiment. As shown in FIG. 1, the image delete apparatus 1 includes a paper feed tray 11 on which recording media for image deletion are mounted, a paper feeding unit 12 that brings out the recording media from the paper feed tray 11, a recording medium carrying unit 20 that carries the recording media, a group of sensors containing a double-feed detection sensor 13 that senses double-feed of the recording media and a media sensor 14 that senses thicknesses of the recording media, and a passage sensor 17 that senses passage of the recording media.

The recording medium carrying unit 20 includes plural carrying rollers 20A and a switching unit 22 that switches between carrying paths.

The double-feed detection sensor 13 includes an ultrasonic generator that generates ultrasonic wave from one side of the recording media toward the recording media, and an ultrasonic sensing device that is provided at the other side of the recording media and senses the ultrasonic wave. The double-feed detection sensor 13 outputs an electric signal based on the sensed ultrasonic wave, and the image delete apparatus 1 determines whether there is double-feed or not based on the signal.

The media sensor 14 includes an arm that is displaced by the passage of the recording media; a permanent magnet provided on the arm, and a magnetic sensor that senses the magnetism of the permanent magnet. The media sensor 14 outputs an electric signal in response to a thickness of the recording medium and the image delete apparatus 1 determines the thickness of the recording medium based on the signal.

For the passage sensor 17, an optical sensor may be used. The image delete apparatus 1 determines that the recording medium is being carried if the output of the passage sensor 17 changes from OFF to ON, and determines that the passage of the recording medium is completed if the passage sensor 17 changes from ON to OFF.

The image delete apparatus 1 includes collecting units 31A, 31B that accumulate the recording media collected at the downstream of the group of sensors in the recording medium carrying direction. The collecting unit 31A is a unit that collects the recording media determined impossible to be carried by the image delete apparatus 1 based on the sensing result of the group of sensors. On the other hand, the collecting unit 31B is a unit that collects the recording media possible to be carried but, from which the images were unsuccessfully deleted.

The collecting unit 31A includes a folding unit 41A and the collecting unit 31B includes a folding unit 41B. As below, the collecting unit 31A and the folding unit 41A will be explained as examples.

The image delete apparatus 1 includes heating units 15 at the downstream of the group of sensors in the recording medium carrying direction. A pair of the heating units 15 are provided at both sides of the recording medium carrying unit 20. The heating units 15 heat the recording media to a color erasing temperature at which the color of a developer on the recording media is erased. Therefore, the image delete apparatus 1 deletes the images of the recording media using the heating units 15.

Any heat source may be used for the heating units 15 as long as the units can heat the recording media to the color erasing temperature or higher. For the heating units 15, for example, thermal heads, halogen heaters, graphite heaters, IH (Induction Heater), rollers formed by heat conducting materials with heat generating lamps inside, or the like may be employed.

The image delete apparatus 1 includes scanners 16A, 16B as image reading units at the downstream of the heating units 15 in the recording medium carrying direction. A pair of the scanners 16A, 16B are provided at both sides of the recording medium carrying unit 20. The image delete apparatus 1 determines whether the images of the recording media were successfully deleted or not based on the outputs of the scanners 16A, 16B.

The image delete apparatus 1 includes stacking units 21A, 21B on which the recording media are accumulated at the downstream of the scanners 16A, 16B in the recording medium carrying direction. The image delete apparatus 1 operates the switching unit 22 to sort the recording media from which the images were unsuccessfully deleted to the collecting unit 31B and the recording media from which the images were successfully deleted to the stacking unit 21A or the stacking unit 21B by sizes of the recording media to stack the recording media on the stacking unit 21A or the stacking unit 21B.

Figure 2:
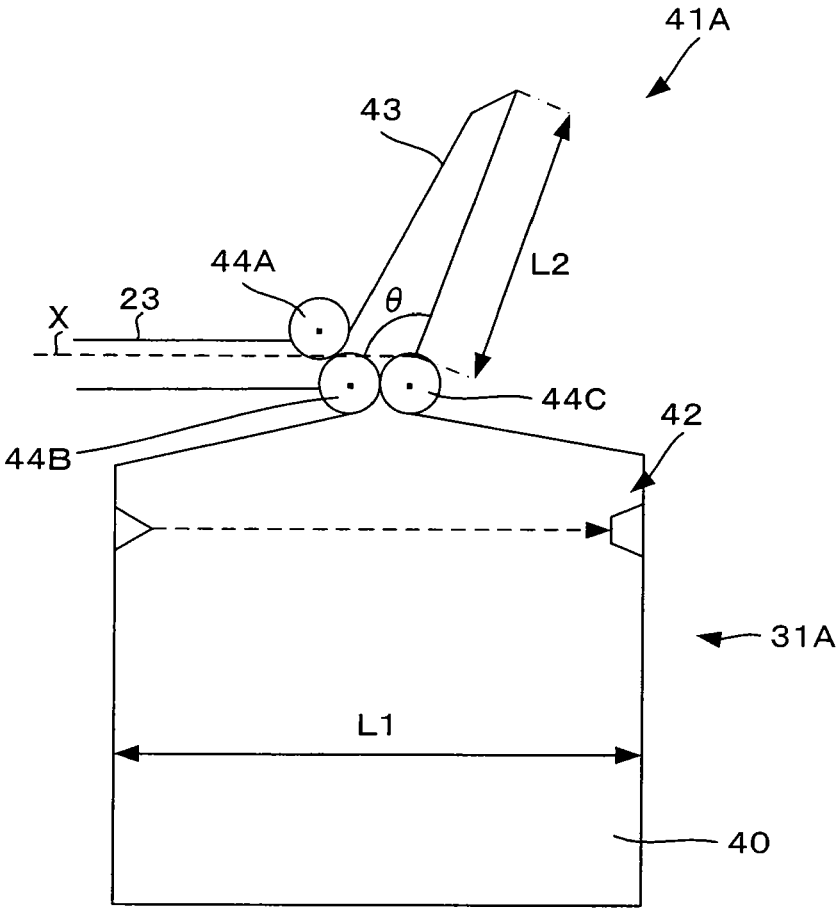
FIG. 2 shows a configuration of a collecting unit.

FIG. 2 shows a configuration of the collecting unit 31A. As shown in FIG. 2, the collecting unit 31A includes the folding unit 41A that folds and buckles the recording media and an accumulating part 40 that accumulates the recording media.

The collecting unit 31A has the folding unit 41A in the upper part of the accumulating part 40. The folding unit 41A includes three driven rollers 44A, 44B, 44C and an auxiliary carrying path 43 connected to a recording medium carrying, path 23 and extending with two nipping parts of the rollers 44A, 44B, 44C inside.

The collecting unit 31A has the first roller 44A so that the rotational shaft of the first roller 44A may be located at the upstream of the rotational shaft of the second roller 44B in the recording medium carrying direction. The first roller 44A and the second roller 44B have the nipping part in the recording medium carrying path 23, and receives the carried recording media and sends them to the auxiliary carrying path 43.

The collecting unit 31A has the third roller 44C so that its rotational shaft maybe located at the downstream of the second roller 44B in the recording medium carrying direction.

The collecting unit 31A has the second roller 44B and the third roller 44C so that the nipping part may be located between the auxiliary carrying path 43 and the accumulating part 40.

The collecting unit 31A has the auxiliary carrying path 43 at an angle θ relative to the carrying direction X of the recording media in the recording medium carrying path 23. θ is larger than 90° and smaller than 180°. The auxiliary carrying path 43 has a length of L2. The length L2 is longer than a half of the length in the carrying direction of the maximum recording medium that can be deleted by the image delete apparatus 1, and shorter than the width L1 of the accumulating part 40. The auxiliary carrying path 43 has a thickness smaller toward the deeper side. The auxiliary carrying path 43 guides the leading ends of the recording media to the downstream of the nipping part of the second roller 44B and the third roller 44C in the recording medium carrying direction.

The collecting unit 31A includes a fill-up sensor 42 that senses that the accumulating part 40 is filled up with the recording media in the accumulating part 40. The fill-up sensor 42 has, for example, a light emitting device on one of the opposed inner surfaces of the accumulating part 40 and a light receiving device on the other. The image delete apparatus 1 determines that the accumulating part is filled up if light is continuously blocked in a predetermined period or more.

Figure 3:
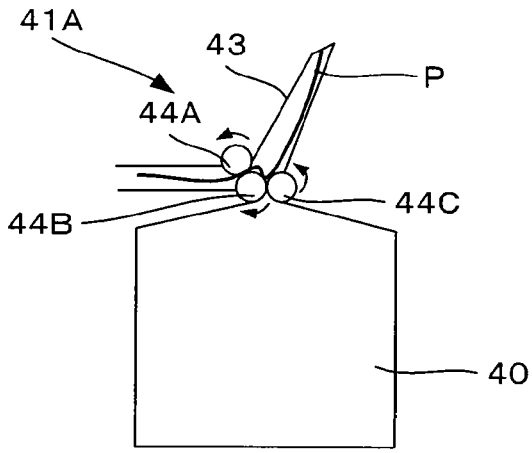
FIG. 3 shows how a folding unit folds a recording medium.
Figure 4:
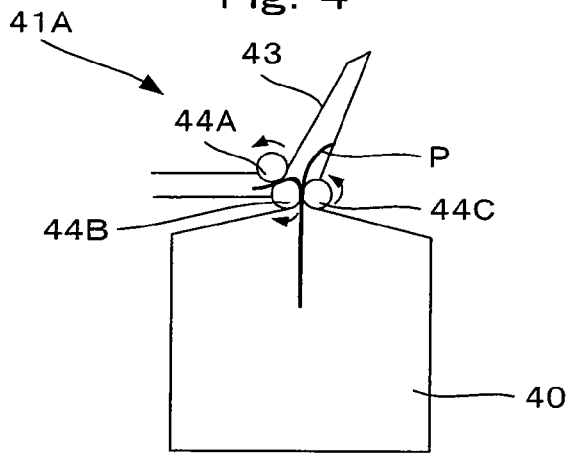
FIG. 4 shows how the folding unit folds the recording medium.
Figure 5:
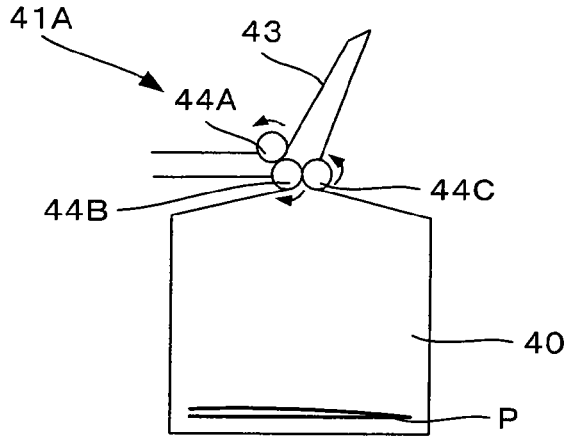
FIG. 5 shows how the folding unit folds the recording medium.

FIGS. 3 to 5 show how the folding unit 41A folds a recording medium. As shown in FIG. 3, the first roller 44A and the second roller 44B send the recording medium P to the auxiliary carrying path 43. When the recording medium P hits the wall at the depth side of the auxiliary carrying path, the recording medium P is buckled in the nipping part of the second roller 44B and the third roller 44C.

As shown in FIG. 4, the first roller 44A and the second roller 44B further send the recording medium P to the auxiliary carrying path 43. The recording medium P is nipped in the nipping part of the second roller 44B and the third roller 44C from the buckled part, folded, and sent to the accumulating part 40.

As shown in FIG. 5, the recording medium P is accumulated in the accumulating part 40 in the folded state.

Figure 6:
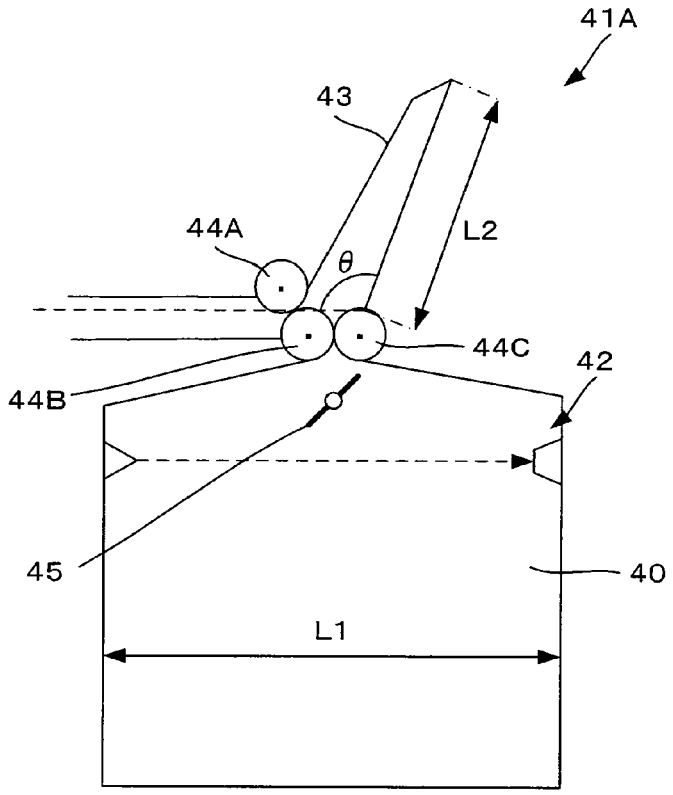
FIG. 6 shows an application example of the collecting unit.

FIG. 6 shows an application example of the collecting unit 31A. As shown in FIG. 6, in addition to the above described configuration of the collecting unit 31A, the collecting unit 31A has a stacking direction switching unit 45.

The collecting unit 31A has the stacking direction switching unit 45 immediately below the nipping part of the second roller 44B and the third roller 44C.

Figure 7:
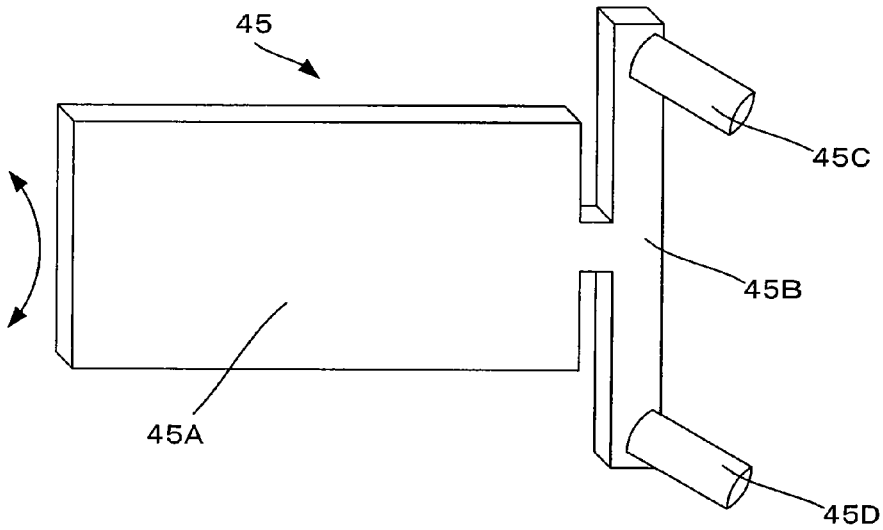
FIG. 7 is a perspective view showing a configuration of a stacking direction switching unit.

FIG. 7 is a perspective view showing a configuration of the stacking direction switching unit 45. As shown in FIG. 7, the stacking direction switching unit 45 includes a flapper 45A, an arm 45B that rotates or turns the flapper 45A, an elastic material 45C that the arm 45B has on one side of the arm 45B, and a flapper driving unit 45D that the arm 45B has on the other side of the arm 45B.

Here, for the flapper driving unit 45D, a solenoid may be used. When the solenoid is turned ON and OFF, the flapper 45A turns.

Figure 8:
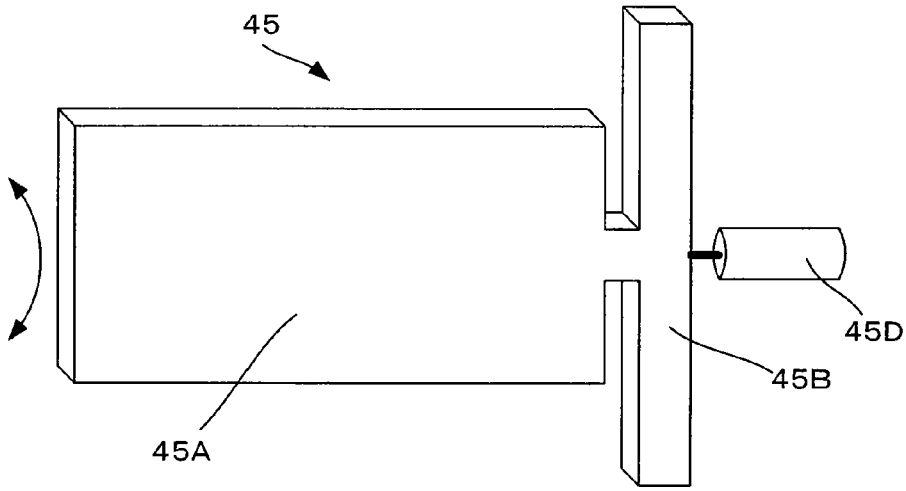
FIG. 8 is a perspective view showing another configuration of the stacking direction switching unit.

FIG. 8 is a perspective view showing another configuration of the stacking direction switching unit 45. As shown in FIG. 8, the elastic material 45C of the stacking direction switching unit 45 shown in FIG. 7 may be removed and a motor may be used for the flapper driving unit 45D in place of the solenoid.

When the motor rotates clockwise or counter-clockwise, the flapper changes its turning direction.

Figure 9:
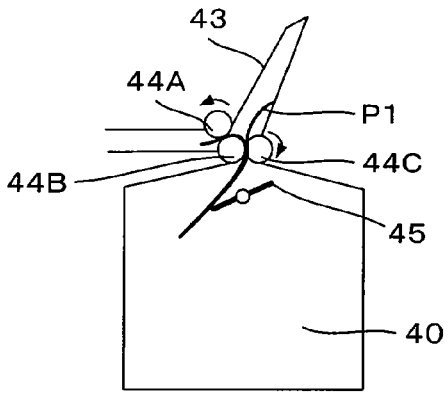
FIG. 9 shows an operation of the stacking direction switching unit.

FIGS. 9 to 12 show an operation of the stacking direction switching unit 45. As shown in FIG. 9, first, the image delete apparatus 1 turns the solenoid of the stacking direction switching unit 45 OFF or rotates the motor counter-clockwise.

The fold line of a recording medium P1 folded by the folding unit 41A is directed to the observer's left in FIG. 9.

Figure 10:
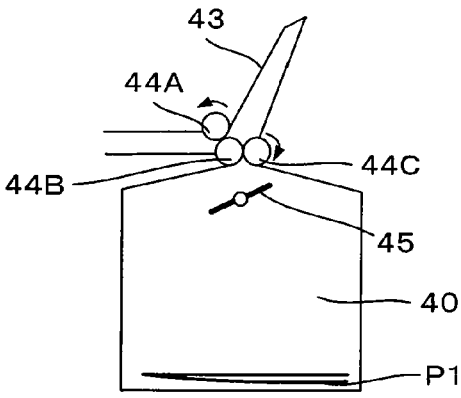
FIG. 10 shows the operation of the stacking direction switching unit.

As shown in FIG. 10, the recording medium P1 is accumulated in the accumulating part 40 with the fold line directed to the observer's left in FIG. 10.

Figure 11:
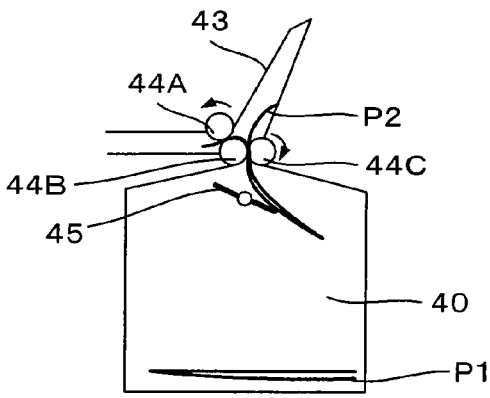
FIG. 11 shows the operation of the stacking direction switching unit.

As shown in FIG. 11, when the image delete apparatus 1 determines the passage of the recording medium P1 based on the output of the passage sensor 17, the apparatus turns the solenoid of the stacking direction switching unit 45 ON or rotates the motor clockwise.

The fold line of a recording medium P2 folded by the folding unit 41A is directed to the observer's right in FIG. 11.

Figure 12:
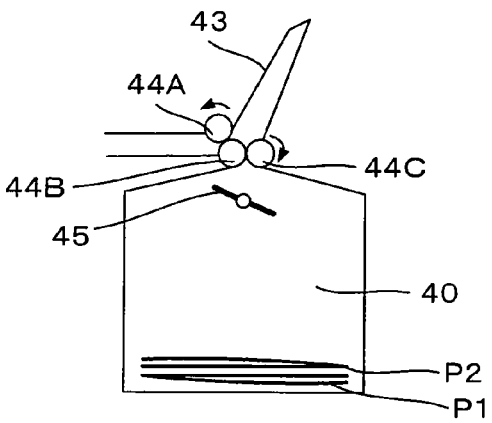
FIG. 12 shows the operation of the stacking direction switching unit.

As shown in FIG. 12, the recording medium P2 is accumulated in the accumulating part 40 with the fold line directed to the observer's right in FIG. 12.

The image delete apparatus 1 drives the flapper driving unit 45D to change the orientation of the flapper and accumulates the recording media in the accumulating part 40 so that the fold lines of the recording media may be alternated.

Figure 13:
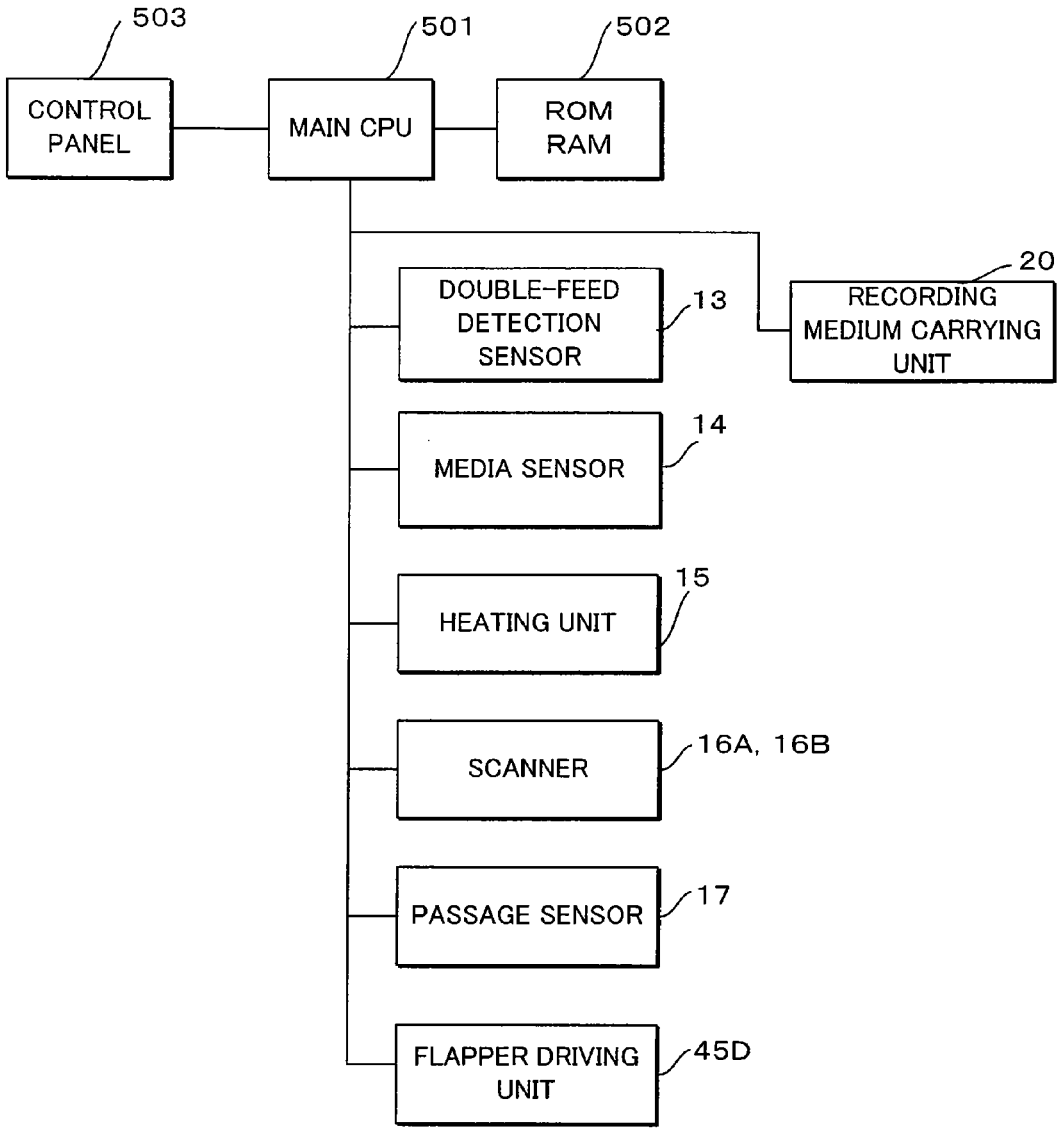
FIG. 13 is a block diagram showing a configuration of the image delete apparatus.

FIG. 13 is a block diagram showing a configuration of the image delete apparatus 1. As shown in FIG. 13, the image delete apparatus 1 includes a main CPU 501 as a control unit. The main CPU 501 is connected to a control panel 503 and a ROM or RAM 502 as a storage device.

The main CPU 501 is connected to the double-feed detection sensor 13, the media sensor 14, the heating units 15, the scanners 16A, 16B, the passage sensor 17, and the flapper driving unit 45D. The main CPU 501 further controls the recording medium carrying unit 20. The main CPU 501 controls ON and OFF and the temperature of the heating units 15.

As described above, the image delete apparatus 1 of the embodiment has the paper feed tray 11 that feeds recording media, the group of sensors containing the double-feed detection sensor 13 that senses double-feed of the recording media and the media sensor 14 that senses thicknesses of the recording media, the folding units 41A, 41B, and the auxiliary carrying path 43, and includes the collecting units 31A, 31B that fold and collect the recording media.

Therefore, there are advantages that the sizes of the collecting units 31A, 31B can be reduced and the size of the image delete apparatus 1 can be reduced.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. An image delete apparatus that deletes an image on a recording medium, comprising:

a paper feed tray configured to store recording media;

a group of sensors comprising a double-feed detection sensor configured to sense double-feed of the recording media;

a collecting unit configured to collect the recording media, the collecting unit having a folding unit and a switching unit, the folding unit having a plurality of rollers that are configured to fold the recording media, the switching unit being disposed below the folding unit in the collecting unit and configured to switch stacking directions of the recording media in the collecting unit; and a heating unit configured to heat the recording media to an erasing temperature or higher, the heating unit being disposed downstream of the group of sensors.

2. The apparatus according to claim 1, wherein the collecting unit further includes:

an accumulating section configured to accumulate the recording media, wherein the folding unit is configured to supply the folded recording media to the accumulating section.

3. The apparatus according to claim 1, wherein the collecting unit further includes:

an accumulating section configured to accumulate the recording media; and an auxiliary carrying path configured to guide leading ends of the recording media to a location that is downstream of a nipping part of the rollers of the folding unit in a recording medium carrying direction.

4. The apparatus according to claim 3, wherein the rollers of the folding unit include:

a first roller provided on an upper end of the accumulating section;

a second roller having a rotational shaft located upstream of the first roller in a recording medium carrying direction and driven with the first roller;

a third roller having a rotational shaft located downstream of the first roller in the recording medium carrying direction and driven with the first roller.

5. The apparatus according to claim 3, wherein the rollers of the folding unit include:

a first roller provided on an upper end of the accumulating section;

a second roller having a rotational shaft located upstream of the first roller in a recording medium carrying direction and driven with the first roller;

a third roller having a rotational shaft located downstream of the first roller in the recording medium carrying direction and driven with the first roller; and the auxiliary carrying path has a depth is longer than a half of the length in the carrying direction of a maximum size recording medium and shorter than a width of the accumulating section.

6. The apparatus according to claim 3, wherein the group of sensors further includes a media sensor that senses thicknesses of the recording media;

the rollers of the folding unit include:

a first roller provided on an upper end of the accumulating section;

a second roller having a rotational shaft located upstream of the first roller in a recording medium carrying direction and driven with the first roller;

a third roller having a rotational shaft located downstream of the first roller in the recording medium carrying direction and driven with the first roller; and the auxiliary carrying path is provided at an angle relative to the recording medium carrying direction, and has a depth that is longer than a half of the length in the carrying direction of a maximum size recording medium and shorter than a width of the accumulating section.

7. The apparatus according to claim 1, wherein the collecting unit includes:

an accumulating section configured to accumulate the recording media, wherein the folding unit is configured to supply the folded recording media to the accumulating section; and the switching unit is configured to alternately change stacking directions of the recording media below the folding unit.

8. The apparatus according to claim 1, wherein the switching unit is configured to change stacking directions of the recording media using a solenoid.

9. The apparatus according to claim 1, wherein the switching unit is configured to switch stacking directions of the recording media using a motor.

10. A recording medium carrying method of an image delete apparatus that deletes an image on a recording medium comprising:

feeding recording media from a paper feed tray;

sensing double-feed of the recording media and thickness of the recording media by a group of sensors comprising a double-feed detection sensor that senses double feed of the recording media;

folding the recording media by a folding unit having a plurality of rollers, while collecting the folded recording media, switching stacking directions of the recording media using a switching unit that is disposed below the folding unit; and heating the recording media to an erasing temperature or higher by a heating unit, the heating is performed after sensing double-feed of the recording media and thickness of the recording media by the group of sensors.

11. The method according to claim 10, wherein the rollers of the folding unit include a first roller, a second roller, and a third roller driven with one another, and an auxiliary carrying path is provided to guide leading ends of the recording media to a location that is downstream of a nipping part of the second roller and the third roller in a recording medium carrying direction.

12. The method according to claim 10, wherein the rollers of the folding unit include:

a first roller;

a second roller having a rotational shaft located upstream of the first roller in a recording medium carrying direction and driven with the first roller; and a third roller having a rotational shaft located downstream of the first roller in the recording medium carrying direction and driven with the first roller, and an auxiliary carrying path is provided to guide leading ends of the recording media to a location that is downstream of a nipping part of the first roller and the third roller in the recording medium carrying direction.

13. The method according to claim 12, wherein the the auxiliary carrying path has a depth that is longer than a half of the length in the carrying direction of a maximum size recording medium and shorter than a width of an accumulating section in which the folded recording media are collected.

14. The method according to claim 13, wherein the group of sensors further contains a media sensor that senses thicknesses of the recording media, and the auxiliary carrying path is provided at an angle relative to the recording medium carrying direction.

15. The method according to claim 10, wherein the stacking directions of the recording media are alternately changed.

16. The method according to claim 10, wherein the stacking directions of the recording media are changed using a solenoid.

17. The method according to claim 10, wherein the stacking directions of the recording media are changed using a motor.

* * * * *